US009622934B2

(12) United States Patent
Wilson

(10) Patent No.: US 9,622,934 B2
(45) Date of Patent: Apr. 18, 2017

(54) POSTURE IMPROVING DEVICE TO ATTACH TO A WALKER

(71) Applicant: William Wilson, Boca Raton, FL (US)

(72) Inventor: William Wilson, Boca Raton, FL (US)

(73) Assignee: William Wilson, Boca Raton, FL (US)

( * ) Notice: Subject to any disclaimer, the term of this patent is extended or adjusted under 35 U.S.C. 154(b) by 0 days.

(21) Appl. No.: 15/161,926

(22) Filed: May 23, 2016

(65) Prior Publication Data

US 2016/0338898 A1 Nov. 24, 2016

Related U.S. Application Data

(60) Provisional application No. 62/165,724, filed on May 22, 2015.

(51) Int. Cl.
*A61H 3/00* (2006.01)
*G08B 21/04* (2006.01)

(52) U.S. Cl.
CPC ..... *A61H 3/00* (2013.01); *G08B 21/0461* (2013.01); *A61H 2201/0184* (2013.01); *A61H 2201/1635* (2013.01); *A61H 2201/5041* (2013.01); *A61H 2201/5043* (2013.01); *A61H 2201/5061* (2013.01)

(58) Field of Classification Search
CPC ..... A61H 3/00; A61H 2201/5061; A61H 2201/5071; A61H 2201/1635; A61H 1/0262; A61H 1/0285; G08B 21/0461
USPC ..... 340/573.1, 573.3, 573.7, 665, 666, 340/825.19; 600/481, 509, 520
See application file for complete search history.

(56) References Cited

U.S. PATENT DOCUMENTS

| | | | |
|---|---|---|---|
| 8,652,051 | B2 | 2/2014 | Twery |
| 2001/0048206 | A1 | 12/2001 | Niu |
| 2003/0160621 | A1 | 8/2003 | Cresswell |
| 2005/0134470 | A1 | 6/2005 | Bos |
| 2009/0013802 | A1 | 1/2009 | Orlewski |
| 2011/0275939 | A1 | 11/2011 | Walsh |
| 2012/0087213 | A1 | 4/2012 | Caldwell |
| 2012/0179226 | A1 | 7/2012 | Graham |
| 2013/0032413 | A1 | 2/2013 | Smith |
| 2013/0091961 | A1 | 4/2013 | Taylor |
| 2014/0090489 | A1 | 4/2014 | Taylor |
| 2016/0253890 | A1* | 9/2016 | Rabinowitz ..... A61H 1/02 |

* cited by examiner

*Primary Examiner* — Hung T Nguyen
(74) *Attorney, Agent, or Firm* — The Gray Law Group, Ltd.; Robert W. Gray, Sr.

(57) ABSTRACT

A device to be added to a walker. The device is used to monitor, correct, and improve the user's posture. The device is removably affixed to the walker and includes a pair of grips which monitor the amount of weight applied to the grips. The device further tracks the weight applied to the grips over time and provides feedback of the weight to the user via the monitor.

12 Claims, 3 Drawing Sheets

POSTURE IMPROVING DEVICE TO ATTACH TO A WALKER

CROSS-REFERENCE TO RELATED APPLICATIONS

This Application claims the benefit of U.S. Provisional Application No. 62/165,724, filed May 22, 2015, which is hereby incorporated by reference.

STATEMENT REGARDING FEDERALLY SPONSORED RESEARCH OR DEVELOPMENT

Not Applicable

PARTIES TO A JOINT RESEARCH AGREEMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The invention relates generally to a retrofitted device for a walker to monitor and improve the user's posture. Currently there are a number of solutions for improving one's posture when using a walker. Some of these solutions attempt to wear a back straightening device that resembles a support garment, but these solutions fail to meet the needs of the market because these items may be difficult to put on for someone with limited mobility. Other solutions attempt to leave the responsibility for keeping good posture on the user or the caretaker of the walker user, but these solutions are similarly unable to meet the needs of the market because it is easy to forget and develop bad habits.

SUMMARY OF THE INVENTION

Accordingly, the invention is directed to an apparatus that provides a means for the user of a walker to be reminded to keep upright posture as opposed to hunching over and putting too much weight on the walker. Furthermore, it would also be advantageous to have an apparatus that could be retrofitted to any existing walker. Therefore, there currently exists a need in the market for an apparatus that monitors, trains, and improves the user's posture as they are using the walker. The device of the present invention has two grips with pressure sensitive plates and a vibration component inside the grips. The grips are in communication with a monitor/screen. The screen will display objective information related to the amount of force the user is placing onto the grips, personal information, history of objectives measures, goals short and long term, plus a speaker for audible tones along with the vibration components in the grips of notifications when preprogrammed forces are surpassed which reminds the user not to slouch over and lean on the walker.

The invention advantageously fills the aforementioned deficiencies by providing a device for addition to a walker to monitor, correct and improve the user's posture. The device alerts the user, physical therapists, family members, caretakers, or friends and reminds the user to stand up straight when the user is leaning too far forward and placing too much weight onto the walker.

The invention includes two grips with pressure sensitive plates and a vibration component inside, wires from each grip that connection to a monitor/screen. The screen will display objective information related to the amount of force through the arms, personal information, history of objectives measures, goals short and long term, plus a speaker for audible tones along with the vibration components in the grips of notifications when preprogrammed forces are surpassed. Plus, alerts can be set up so it can notify you by either vibration or audible stimulus when the predetermine loads are surpassed.

The apparatus has ergonomic formed grips with weight recording sensors. The grips vibrate when excess weight is applied. The apparatus, has a seven-inch adjustable, touch screen monitor. The apparatus fulfills the need for a device to remind the user of a walker not to lean and slouch over the walker. Among other things, it is an advantage of the invention to provide a device to add to a walker to monitor, correct and improve the user's posture that does not suffer from any of the problems or deficiencies associated with prior solutions. It is still further an advantage of the invention to initially be programmed by a physical therapist, but then can be monitored by you the patient.

Additional features and advantages of the invention will be set forth in the description which follows, and will be apparent from the description, or may be learned by practice of the invention. The foregoing general description and the following detailed description are exemplary and explanatory and are intended to provide further explanation of the invention.

BRIEF DESCRIPTION OF THE DRAWING

The accompanying drawing is included to provide a further understanding of the invention and is incorporated into and constitutes a part of the specification. It illustrates one embodiment of the invention and, together with the description, serves to explain the principles of the invention.

DETAILED DESCRIPTION OF THE INVENTION

Figure 1:
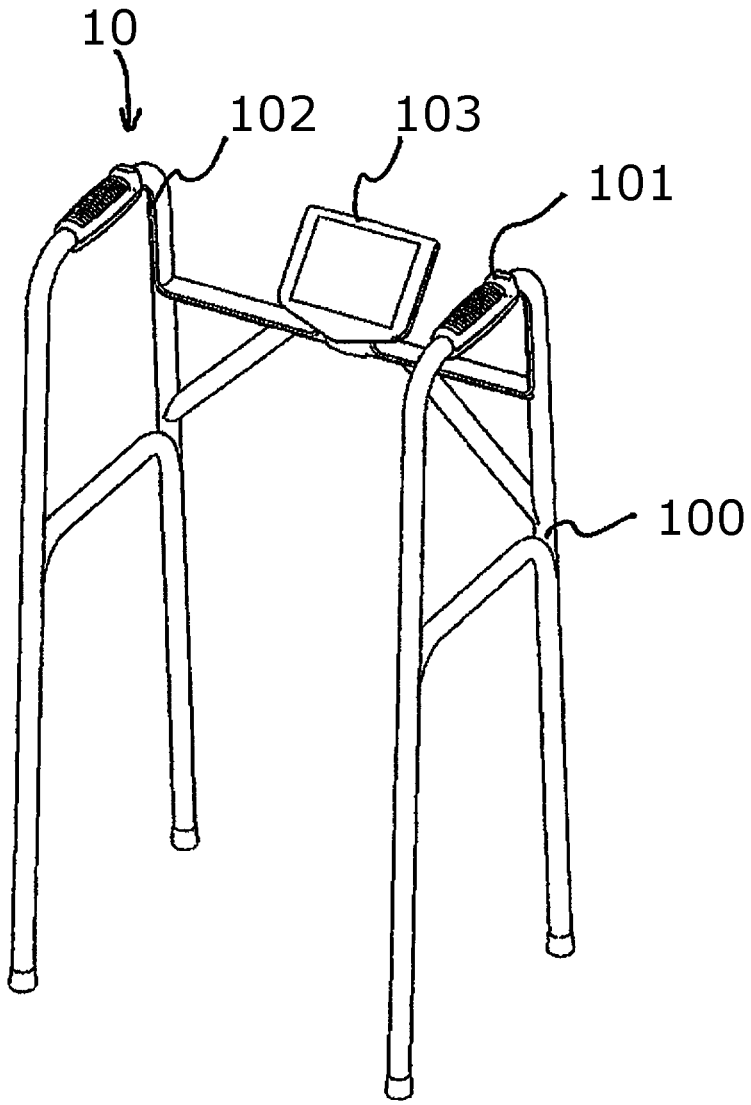
FIG. 1 shows an isometric view of the device installed on a walker, according to the present invention.

The following detailed description includes references to the accompanying drawings; which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations. As used herein, the term "and/or" refers to any one of the items, any combination of the items, or all of the items with which this term is associated. As used herein, the singular forms "a," "an," and the include plural reference unless the context clearly dictates otherwise. As used herein, the terms "include," "for example," "such as," and the like are used illustratively and are not intended to limit the present invention. As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the, invention. As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications. As used herein, the term "coupled" means the joining of two members directly or indirectly to one another. Such joining may be stationary in nature or movable in nature and/or such joining may allow for the flow of fluids, electricity, electrical signals, or other types of signals or communication between two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

The invention is directed to a posture improving walker attachment, intended to correct and improve the user's posture.

The invention is a device, which is added to a walker to monitor, train, and improve the user to use the walker judiciously and not lean over the walker for resting support which leads to poor posture. The invention has two grips 101 with pressure sensitive plates 105 in communication with a monitor/screen 103 and a vibration component 107. The monitor/screen 103 will display objective information related to the amount of force placed onto the grips 101 through the user, personal information, history of objectives measures, goals short and long term, plus a speaker for audible tones along with the vibration components 107 in the grips of notifications when preprogrammed forces are surpassed.

Figure 2:
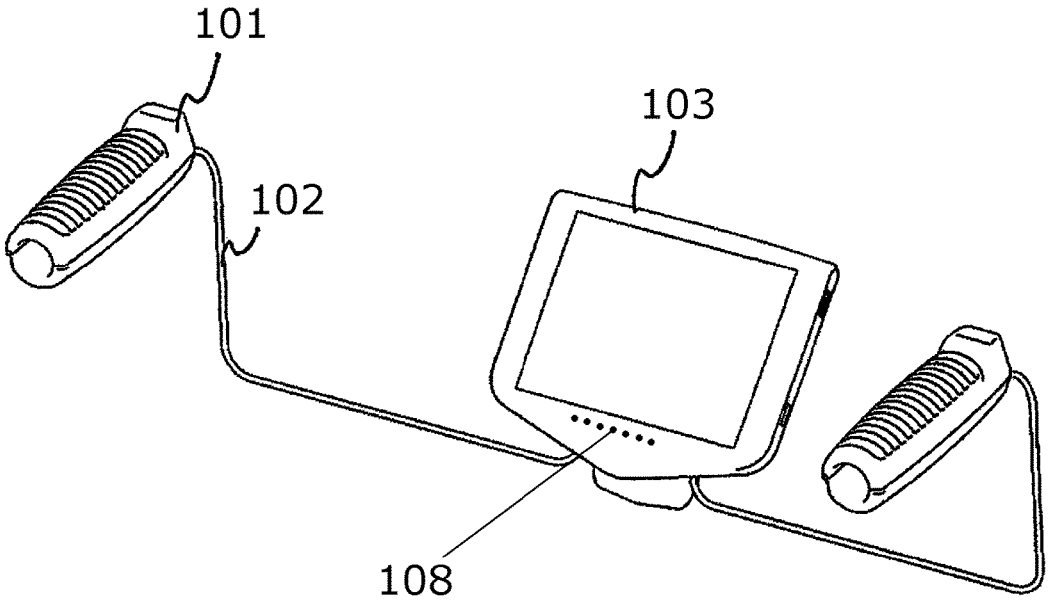
FIG. 2 shows an isometric front side view of the device, according to the present invention.
Figure 3:
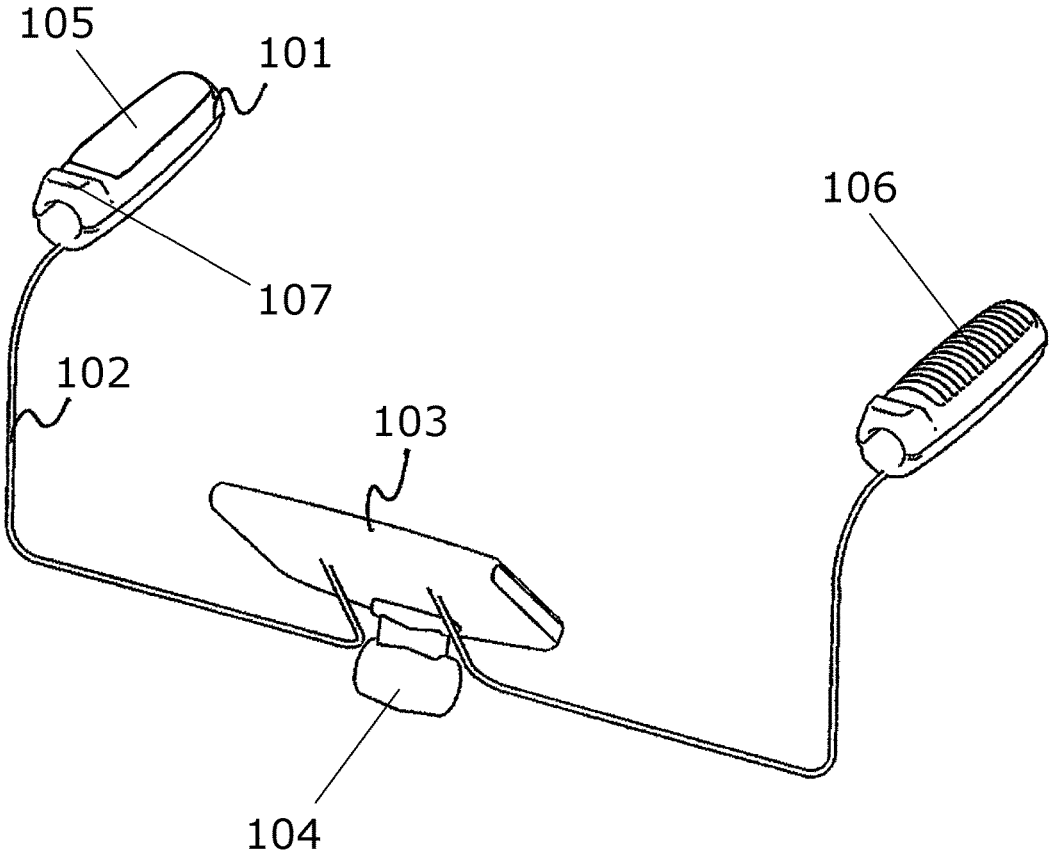
FIG. 3 shows an isometric rear side view of the device, according to the present invention.

Referring to the figures, FIG. 1-3 show the posture improving device for attachment to a walker 100, according to the present invention and generally referred to as device 10. The device 10 is designed for attachment to a standard walker 100 and monitors the grip pressure and amount of downward force applied to the walker 100 to allow a user to self-correct their posture. The device 10 includes a pair of grips 101 attached to the handle portion of the walker 100. The pair of grips are located on each handle of the walker 100. The grips 101 are easily and removably affixed to any standard walker 100 allowing for universal usage. The grips 101 may be affixed utilizing any securing or fastening means including, but not limited to, compression fitting, snap fitting, hook and loop, fasteners, zip-ties, cable ties, adhesive, or other similar fastening and securing means.

The grips 101 include a plurality of components including electronic components. These components are designed to monitor the amount of force applied to the grips 101 to determine the amount of weight being applied to the grips 101 through the user's hands. Therefore, the grips 101 will include a pressure plate 105 that records and in real-time provides information related to the amount of weight being applied to the grips 101. The pressure plate 105 being located underneath the comfort padding 106 on the grips 101. The pressure plate 105 can be seen in FIG. 3 where the comfort padding 106 has been removed from the grip 101. The grips 101 may also include a vibration motor 105 or speaker 108 and audible tone to alert the user when a threshold amount of weight is placed on to the grips 101.

The grips 101 are in communication with a monitor/screen 103 through a communication means 102. Preferably to keep costs down and provide ease of use, this communication means is a wire 102, but it may also be wireless. The monitor/screen 103 is secured to the cross brace of the walker 100 with any means of fastening such as a clip, clamp, or hook. The monitor/screen is preferably easily visible to the user. The monitor/screen 103 will display the weight applied to the grips 101 in real-time to the user to provide instant feedback and display usage and measurements over time. The device 10 can be initially programmed by a therapist and then used by a patient user to track and monitor progress.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims.

Components, component sizes, and materials listed above are preferable, but artisans will recognize that alternate components and materials could be selected without altering the scope of the invention.

While the foregoing written description of the invention enables one of ordinary skill to make and use what is presently considered to be the best mode thereof, those of ordinary skill in the art will understand and appreciate the existence of variations, combinations, and equivalents of the specific embodiment, method, and examples herein. The invention should, therefore, not be limited by the above described embodiment, method, and examples, but by all embodiments and methods within the scope and spirit of the invention.

I claim:

1. A posture improving walker attachment, comprising: a monitor; grips; said monitor and said grips being in communication with each other; said grips being configured and sized to removably attach to an each handle portion of a walker; said monitor being configured to removably attach to a cross bar of said walker; said grips comprising a pressure plate such that the pressure applied downward on the grip is measured in real time and recorded as a pressure measurement; said grips sending the pressure measurement to the monitor; said monitor displaying objective information related to the pressure measurement as an amount of weight being applied to the grips which could be viewed by a user for allowing the user to self-correct a posture.

2. The posture improving walker attachment of claim 1, wherein the monitor is programmed with predetermined levels of acceptable pressure; such that, if the pressure measurement in the grips exceeds the predetermined levels of acceptable pressure an alert occurs.

3. The posture improving walker attachment of claim 1, wherein said grips and said monitor are connected via wires; said wires being configured to transmit information between the grips and the monitor.

4. The posture improving walker attachment of claim 2, wherein said grips and said monitor are connected via wires; said wires being configured to transmit information between the grips and the monitor.

5. The posture improving walker attachment of claim 2, wherein said grips further comprises a vibration component such that the grips will vibrate if the alert occurs.

6. The posture improving walker attachment of claim 4, wherein said grips further comprises a vibration component such that the grips will vibrate if the alert occurs.

7. The posture improving walker attachment of claim 2, said monitor further comprises a speaker; such that said speaker makes a noise if the alert occurs.

8. The posture improving walker attachment of claim 4, said monitor further comprises a speaker; such that said speaker makes a noise if the alert occurs.

9. The posture improving walker attachment of claim 5, said monitor further comprises a speaker; such that said speaker makes a noise if the alert occurs.

10. The posture improving walker attachment of claim 6, said monitor further comprises a speaker; such that said speaker makes a noise if the alert occurs.

11. The posture improving walker attachment of claim 1, wherein the monitor displays current pressure on the grips in comparison to a predetermined amount.

12. The posture improving walker attachment of claim 1, wherein said grips and said monitor are in wireless communication such that information is transmitted between the grips and the monitor.

* * * * *